US005136727A

United States Patent [19]

Brisco

[11] Patent Number: 5,136,727

[45] Date of Patent: Aug. 11, 1992

[54] EXERCISE SHORTS

[76] Inventor: Gregory J. Brisco, P.O. Box 128, Bryn Athyn, Pa. 19009

[21] Appl. No.: 706,221

[22] Filed: May 28, 1991

[51] Int. Cl.[5] ..... A41D 1/08; A41C 11/00

[52] U.S. Cl. ..... 2/409; 2/69; 2/70; 2/71; 2/228; 2/243 A; 66/177

[58] Field of Search ..... 2/67, 69, 70, 71, 72, 2/79, 227, 228, 409, 243 A, 109, 110, 69, 79, 243 R, 239; 66/171, 176, 175, 177, 178 R, 178 A

[56] References Cited

U.S. PATENT DOCUMENTS

| | | | |
|---|---|---|---|
| Re. 25,360 | 3/1963 | Rice | 2/409 |
| 563,408 | 7/1896 | Pfister | 2/67 |
| 2,714,757 | 8/1955 | Leath et al. | 66/178 A |
| 3,449,932 | 6/1969 | Fillmore et al. | 2/409 X |
| 3,463,162 | 8/1969 | Heggie | 2/409 |
| 3,599,241 | 8/1971 | Rossler | 2/409 |
| 3,641,589 | 2/1972 | Bryant | 2/409 |
| 3,678,514 | 7/1972 | Safrit | 2/409 X |
| 3,678,515 | 7/1972 | Wehrmann | 2/409 |
| 3,701,164 | 10/1972 | Blore | 66/177 |
| 3,711,866 | 1/1973 | Vorberg | 2/409 |
| 3,757,354 | 9/1973 | Moody | 66/177 X |
| 3,815,156 | 6/1974 | Gaither | 2/409 |
| 3,909,851 | 10/1975 | Garrou et al. | 2/409 |
| 3,914,799 | 10/1975 | Newmar | 2/409 |
| 4,100,624 | 7/1978 | Davis | 2/409 |
| 4,213,312 | 7/1980 | Safrit et al. | 2/409 X |
| 4,267,607 | 5/1981 | Tuno | 66/177 X |
| 4,351,068 | 9/1982 | Taylor | 2/409 |
| 4,903,345 | 2/1990 | Oakley | 66/177 X |
| 4,920,769 | 5/1990 | Rickerl | 66/177 X |
| 4,999,845 | 3/1991 | Jenks, Jr. et al. | 2/67 X |
| 4,999,854 | 3/1991 | Fell | 2/409 |
| 5,023,957 | 6/1991 | Harvey | 66/177 X |
| 5,038,414 | 8/1991 | Freeman | 66/178 A |
| 5,040,245 | 8/1991 | Staley | 66/178 R |
| 5,052,058 | 10/1991 | Mueller | 2/409 X |

FOREIGN PATENT DOCUMENTS

| | | | |
|---|---|---|---|
| 1243319 | 3/1963 | Fed. Rep. of Germany | 2/409 |
| 1262178 | 3/1968 | Fed. Rep. of Germany | 2/409 |
| 2134219 | 1/1973 | Fed. Rep. of Germany | 2/409 |
| 1191122 | 10/1959 | France | 2/409 |
| 1214554 | 4/1960 | France . | |
| 2153609 | 5/1973 | France | 2/409 |
| 2267716 | 11/1975 | France | 2/409 |
| 2290855 | 6/1976 | France | 2/409 |
| 2303491 | 10/1976 | France | 2/409 |
| 2467557 | 5/1981 | France | 2/79 |
| 2498059 | 7/1982 | France | 2/79 |
| 732192 | 6/1955 | United Kingdom | 2/409 |
| 1266927 | 3/1972 | United Kingdom | 2/409 |
| 2209657 | 5/1989 | United Kingdom | 2/409 |
| 2214407 | 9/1989 | United Kingdom | 2/409 |

*Primary Examiner*—Werner H. Schroeder
*Assistant Examiner*—Jeanette E. Chapman
*Attorney, Agent, or Firm*—Fishman, Dionne & Cantor

[57] ABSTRACT

An athletic garment for covering a wearers pelvic region and at least a portion of the wearer's legs includes a ventilating portion, for covering the wearer's pelvic region and allowing rapid heat transfer from the wearer's pelvic region, and a pair of form fitting resilient tubular portions, for covering at least a portion of each of the wearer's legs, for providing resilient support for the covered leg portions and for insulating the covered leg portions to slow heat transfer from the covered leg portions. The garment may also include an outer shell for covering the ventilating portion of the garment.

14 Claims, 2 Drawing Sheets

EXERCISE SHORTS

BACKGROUND OF THE INVENTION

Athletic clothing is designed to provide comfort, freedom of movement and a fashionable appearance. Resilient, stretchable tights are known which offer a comfortable, supportive fit that allows for freedom of movement, insulates the wearer's legs to retain heat during exercise and which provide a relative freedom from chaffing due the tightly form-fitting configuration of the tights. Some potential wearers are discouraged from wearing such tight fitting garments on the basis of personal modesty or on an esthetic basis because, e.g. they find tight fitting fabrics too anatomically revealing. Other potentional wearers are discouraged by their concerns regarding potential discomfort arising from the lack of ventilation inherent in covering the pelvic region with a tight fitting and heat retaining layer. Some users have chosen to address the esthetic objections by layering resilient tights under other athletic garments, e.g. loose-fitting shorts, but in many cases this approach proves to be somewhat uncomfortable due to the bulkiness of the multiple layers of fabric involved and due to the potential overheating during exertion.

SUMMARY OF THE INVENTION

An athletic garment for covering a wearer's pelvic region and at least a portion of the wearer's legs is disclosed. The garment is designed to be layered underneath a pair of short pants. The garment includes ventilation means for covering the wearer's pelvic region and for allowing rapid heat transfer from the wearer's pelvic region and form-fitting support means for covering at least a portion of each of the wearer's legs for providing resilient support for the covered leg portions and for insulating the covered leg portions to slow heat transfer from the covered leg portions.

The ventilation means define a waist opening and a pair of legs openings and the support means comprise a tubular members wherein one of the tubular members extends from each of the legs openings of the ventilation means.

In a preferred embodiment, the ventilation means comprises a light weight permeable fabric and the support means comprises a medium weight elastic fabric.

In a preferred embodiment, the support means cover the upper portions of each of the wearer's legs.

In an alternative embodiment, the garment further comprises an outer shell means for covering the ventilation means. The outer shell means defines a waist opening and a pair of leg openings, and the support means extend outwardly through the shell leg openings.

In a preferred embodiment, the garment may further comprise a waistband means secured to the ventilation means waist opening and shell means waist opening for adjusting the waist openings to fit the wearer.

DETAILED DESCRIPTION OF THE INVENTION

Figure 1:
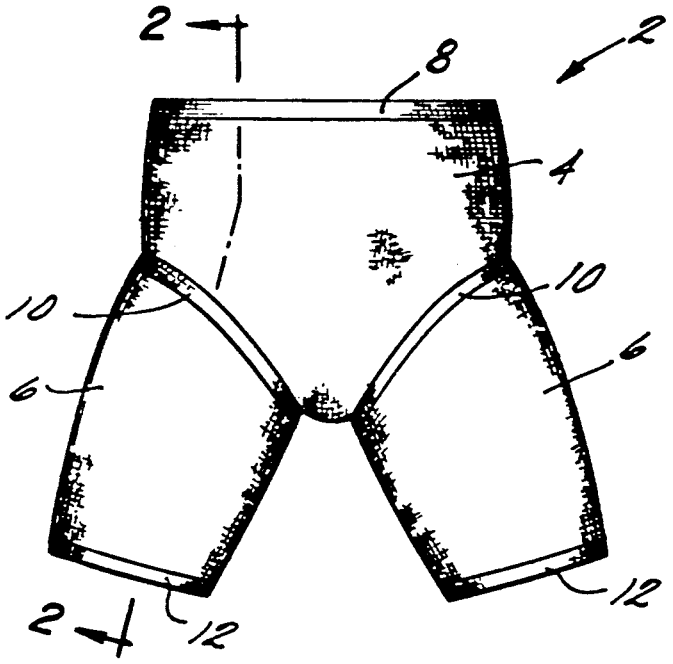
FIG. 1 shows a front view of one embodiment of the athletic garment of the present invention.

FIG. 1 shows a front view of a first embodiment of the athletic garment 2 of the present invention. The garment 2 includes an upper portion ventilation means 4 for covering the wearer's pelvic region and form fitting support means, i.e. a pair portions 6 for covering at least a portion of each of the wearer's legs.

The upper portion 4 may comprise any material that allows a rapid heat transfer from the wearer's pelvic region during exercise. Preferably, the upper portion 4 comprises a light weight, permeable, woven fabric. Suitable fabrics comprise, e.g. cotton, polyester and nylon fabrics. In a preferred embodiment, the light weight permeable fabric of the upper portion 4 comprises an open mesh fabric. A suitable open mesh fabric is known as textured polyester mesh with 2 mm holes made by GAME TIME FABRICS.

The leg portions 6 of garment 2 may comprise any material which provides resilient support for the covered leg portions and which insulates the covered leg portions to slow heat transfer from the covered leg portions during exercise. Materials suitable for the leg portions 6 of garment 2 include light or medium weight or elastic fabrics. Preferably, the leg portions 6 of garment 2 comprise from about 85 volume percent to about 95 volume percent non-elastic fibers and from about 5 volume percent to about 15 volume percent elastomeric fibers. Polyurethane block copolymer elastomeric fibers such as Lycra® (DuPont) fibers are preferred as the elastomeric fibers.

Figure 2:
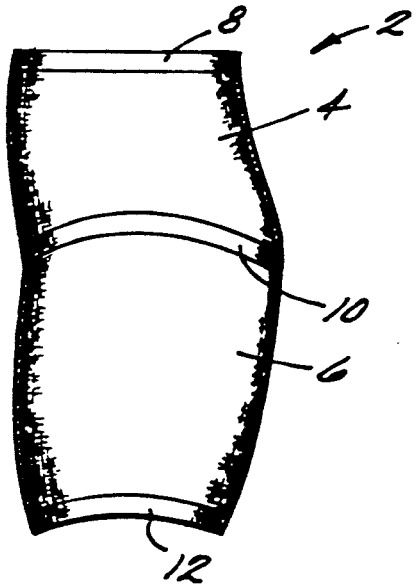
FIG. 2 shows a cross sectional view of the garment shown in FIG. 1 along line 2—2.

The garment 2 shown in FIGS. 1 and 2 includes a waistband 8, and upper leg band 10 and a lower leg band 12. The waistband 8 comprises a band of elastomeric material for adjusting the waist opening to fit the wearer. Alternatively, the waistband 8 may comprise a drawcord or a belt. In a preferred embodiment, the leg bands 10 comprise hook-and-loop fastener material, thereby enabling the leg portions to be removably secured to upper portion 4. The legs bands preferably comprise a band of fabric similar to that of leg portions 6 but including a higher proportion of elastomeric fibers.

Figure 3:
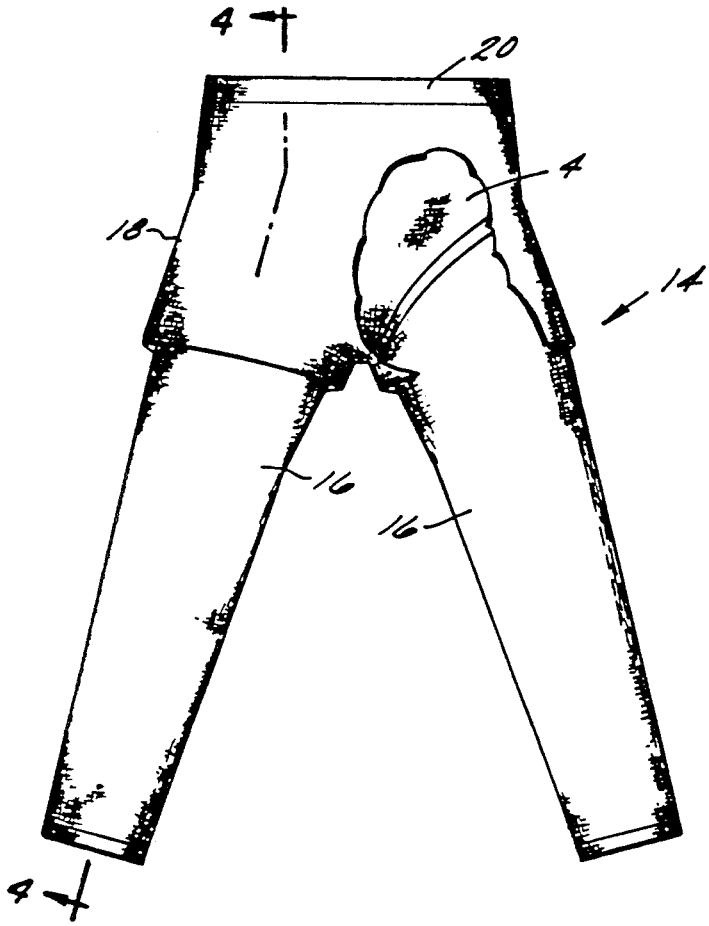
FIG. 3 shows a partially broken away front view of an alternative embodiment of garment of the present invention.
Figure 4:
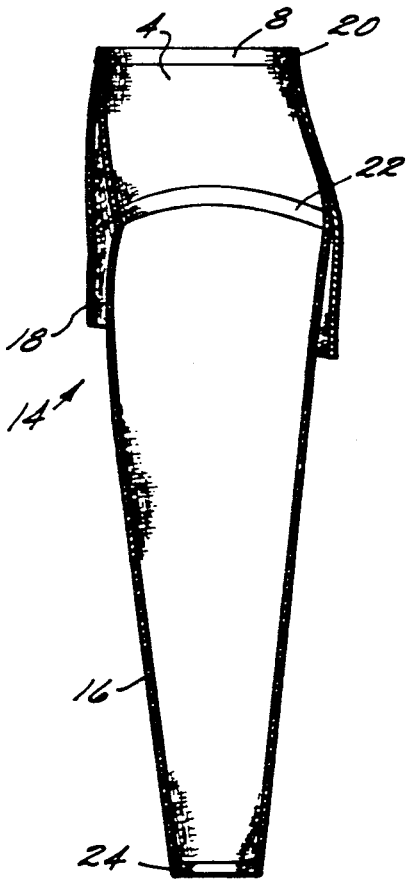
FIG. 4 shows a cross sectional view taken along line 3—3 of the embodiment shown in FIG. 3.

FIGS. 3 and 4 show an alternative embodiment 14 of the garment of the present invention. Garment 14 includes an upper portion 4 and leg portions 16 analogous to those shown in the embodiment of FIGS. 1 and 2. Leg portions 16 of garment 14 are elongated and designed to cover the wearer's leg from the hip to the ankle.

The embodiment 14 further includes a shell 18 for covering the upper portion 4 of the garment 14 the shell 18 may comprise any durable material. Materials suitable for use as shell 18 include, e.g. woven fabrics. Suitable woven fabrics include cotton, polyester, and nylon woven fabrics. Preferably the shell comprises Supplex® (DuPont) nylon.

The garment 14 includes waistband 20 analogous to that in the garment 2 except that upper portion 4 and shell layer 18 are joined at waistband 20 of garment 14.

Garment 14 includes an upper leg band 22 and a lower a leg band 24 analogous to leg bands 10 and 12 of garment 2.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. An athletic garment for covering a wearer's pelvic region and at least a portion of the wearer's legs, comprising:

ventilation means for covering the wearer's pelvic region, said ventilation means allowing rapid heat transfer from the wearer's pelvic region and defining a waist opening and a pair of leg openings; and form fitting support means attached to said leg openings for covering at least a portion of each of the wearer's legs, said support means including a pair of resilient tubular members wherein one of said tubular members extends from each of said leg openings for providing resilient support for the covered leg portions and for insulating the covered leg portions to slow heat transfer therefrom, said form fitting support means comprising a medium weight elastic fabric having from about 5 volume percent to about 15 volume percent of elastomeric fibers and from about 85 volume percent to about 95 volume percent of non-elastomeric fibers.

2. The garment of claim 1 wherein the ventilation means comprises a light weight permeable fabric.

3. The garment of claim 2 wherein the light weight permeable fabric is selected from the group consisting of cotton, polyester or nylon.

4. The garment of claim 2, wherein the light weight, permeable fabric comprises a light weight, permeable open mesh woven fabric.

5. The garment of claim 1 wherein the elastomeric fibers comprise a polyurethane block copolymer.

6. The garment of claim 1 further comprising waistband means surrounding the waist opening of the ventilation means for adjusting the waist opening to fit the wearer.

7. The garment of claim 6 wherein the waistband means comprises a band of elastomeric material.

8. The garment of claim 1 further comprising means for removably securing the resilient tubular members to the ventilation means.

9. The garment of claim 8 wherein the means for removably securing comprise hook-and-loop fasteners.

10. The garment of claim 1, wherein each of the wearer's legs include an upper portion extending from the wearer's pelvic region to the wearer's knee and the support means cover the upper portion of each of the wearer's legs.

11. The garment of claim 10, wherein each of the wearer's legs further includes lower portion extending from the knee to the ankle and the support means cover the upper and lower portions of the wearer's leg.

12. The garment of claim 1, further comprising outer shell means for covering the ventilation means.

13. The garment of claim 12, the outer shell means define a shell waist opening and a pair of shell leg openings and wherein said support means extend outwardly through said shell leg openings.

14. The garment of claim 13, further comprising waistband means, secured to the ventilation means waistband opening and the shell waistband opening, for adjustment to waistband opening to fit the wearer.

* * * * *